US007168970B2

(12) United States Patent
Thiele et al.

(10) Patent No.: US 7,168,970 B2
(45) Date of Patent: Jan. 30, 2007

(54) HOLDER FOR ELECTRICAL UNITS

(75) Inventors: Jürgen Thiele, Kierspe (DE); Hans-Peter Mews, Lüdenscheid (DE)

(73) Assignee: Vossloh-Schwabe Deutschland GmbH, Ludenscheid (DE)

( * ) Notice: Subject to any disclaimer, the term of this patent is extended or adjusted under 35 U.S.C. 154(b) by 692 days.

(21) Appl. No.: 10/405,928

(22) Filed: Apr. 3, 2003

(65) Prior Publication Data

US 2003/0214778 A1 Nov. 20, 2003

(30) Foreign Application Priority Data

Apr. 4, 2002 (DE) ..... 102 14 922

(51) Int. Cl.
*H01R 33/02* (2006.01)

(52) U.S. Cl. ..... 439/226

(58) Field of Classification Search ..... 439/226, 439/232, 152, 356, 923, 483
See application file for complete search history.

(56) References Cited

U.S. PATENT DOCUMENTS 228,646 A * 6/1880 Summers ..... 366/258
2,198,803 A 4/1940 Carter, Jr.
2,282,875 A 5/1942 Mueller
2,570,104 A 10/1951 De Reamer et al.
3,851,295 A * 11/1974 Geier ..... 439/232
4,795,357 A 1/1989 Kosmol et al.
5,145,392 A 9/1992 Kemp

OTHER PUBLICATIONS

Patent Abstracts of Japan, vol. 016, No. 312, Jul. 9, 1992, JP 4-087174, Mar. 19, 1992.

* cited by examiner

*Primary Examiner*—Tho D. Ta
*Assistant Examiner*—Vanessa Girardi
(74) *Attorney, Agent, or Firm*—Foley & Lardner LLP

(57) ABSTRACT

A holder (6), which is suitable in particular for luminaires which do not provide any direct manual access to the capped lighting means, has a slide by means of which the lamp cap and/or the contact pins thereof can be pushed out of the holder or at least released from the holder. In the case of a preferred embodiment, the holder housing (8) is designed in two parts, the housing part (9) being designed as the slide.

23 Claims, 7 Drawing Sheets

HOLDER FOR ELECTRICAL UNITS

FIELD OF INVENTION

The invention relates to a holder for electrical units, in particular for fluorescent lamps.

BACKGROUND OF THE INVENTION

Priority is claimed to corresponding German patent application 102 14 922 filed Apr. 4, 2002, the disclosure of which is hereby incorporated by reference herein its entirety.

Fluorescent lamps and other rod-like light sources are occasionally installed in luminaires in which constricted conditions prevail. In particular, if reflectors are arranged at a small distance from the lighting means, it is difficult to gain access to the lighting means, as is necessary in order to remove the latter, for example, from the holders. In the case of a fair number of luminaire designs, the reflectors arranged on the lighting means are arranged in such close proximity to the light means that the light means can be neither rotated nor moved radially by hand.

SUMMARY OF THE INVENTION

The invention provides a holder which allows the lighting means to be changed, even in the case of luminaires where the access to the lighting means is restricted.

A holder according to one embodiment of the invention has a holder housing with at least one contact element for the contact-connection of the unit. The holder serves both for securing the lighting means and for providing the supply of electricity to the latter. Provided on the holder is a release device by means of which the unit can be guided out of its operating position. The release device thus assists the operation of the unit being guided out of its holder. It is provided with a manual actuating device. The latter is arranged at an accessible location which is spaced apart from the lighting means. The actuating device is preferably arranged on that side of the holder from which the lighting means is to be inserted into the holder. The actuating device is formed, for example, by a profiled continuation which serves as a handle. This preferably extends away from the holder in the radial direction in relation to a center axis of a rod-like lighting means. This allows good access to the actuating device and thus a straightforward changeover of the lighting means.

The holder housing is preferably provided with two introduction slots for two contact pins of the unit, the lighting means being inserted into the introduction slots by a linear, radial pushing movement and being latched therein. The contact regions of the contact elements are preferably arranged in the end region of the introduction slots. The contacts may be designed, at the same time, as latching means in order to retain the lighting means in the holder. It is alternatively possible to provide other latching means, for example on the holder housing.

The length of the introduction slots is preferably greater than the sum of the spacing of the contact pins from one another and the length of the end region of the introduction slots, in which the contact elements and/or the contact regions thereof are located. This achieves protection against electric shocks during changeover of the lighting means.

In the case of a preferred embodiment, the holder has a housing part which is mounted such that it can be moved between an operating position and a release position. The housing part thus forms a release element by which the light means can be transferred from its operating position to its release position, i.e. ultimately, can be pushed out of the holder. The moveable housing part is preferably the front housing part which is directed toward the lighting means and is mounted on a rear part. The rear part preferably bears the contact elements and can be fastened in a stationary manner on a lamp carrier.

A grip element is preferably provided on the moveable housing part for the manual displacement of the latter, the grip element forming the actuating device. The grip element is preferably arranged between two introduction slots, and it extends in the same direction as the latter. It is easily accessible here. Moreover, the arrangement between the two introduction slots results in symmetrical loading during transfer from the operating position into the release position, with the result that the two housing parts do not jam or tilt in relation to one another.

The front, displaceable housing part may be assigned a latching means, which latches the housing part in its operating position. A relatively weak latching action is sufficient.

Further details of advantageous embodiments of the invention are described below.

BRIEF DESCRIPTION OF THE DRAWINGS

An exemplary embodiment of the invention is illustrated in the drawing, in which.

DETAILED DESCRIPTION OF PREFERRED EMBODIMENTS

Figures 1, 2:
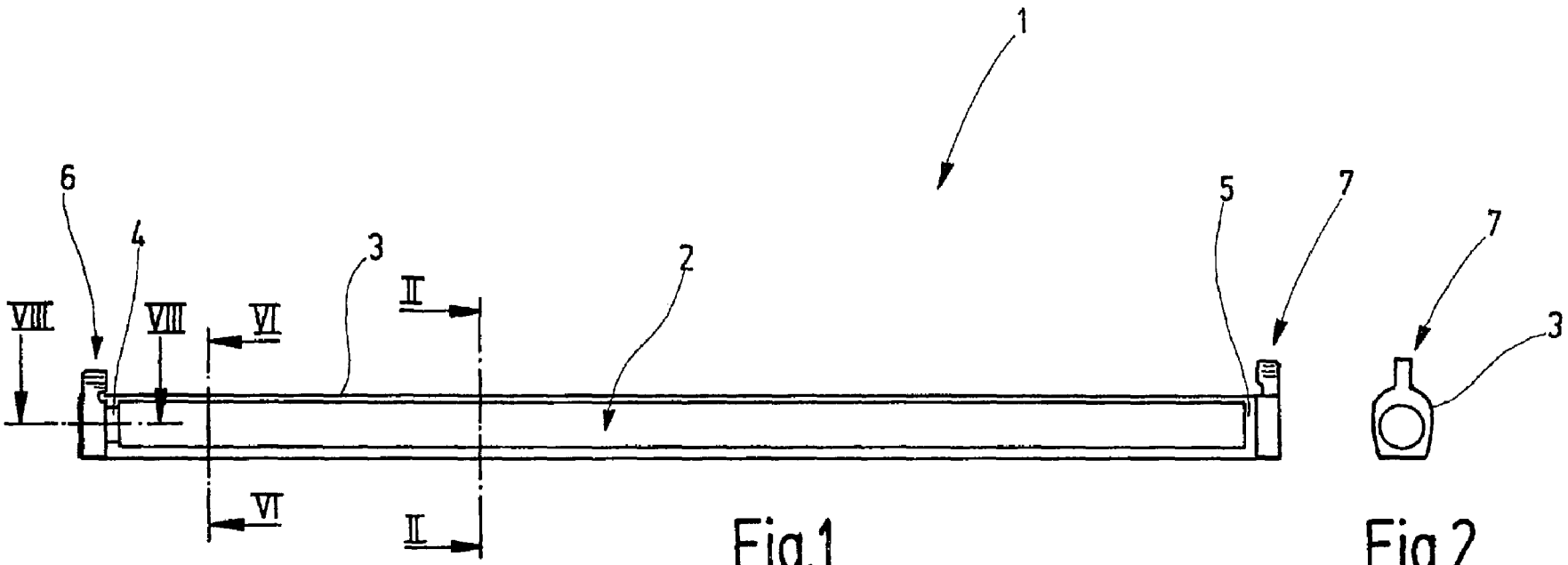
FIG. 1 shows a side view of a luminaire with a rod-like lighting means and two lamp holders.
FIG. 2 shows the luminaire according to FIG. 1 in section along line II—II.

FIG. 1 illustrates a luminaire 1 with a fluorescent lamp 2, which is arranged within a cross-sectionally u-shaped (FIG. 2) reflector 3. The fluorescent lamp has a tubular glass body with two-pin caps 4, 5 arranged at both ends. They are retained mechanically, and electrically contact-connected, in identical holders 6, 7. The holders 6, 7 are identical and designed, in particular, with respect to the particular conditions in the luminaire 1. These reside in the narrow reflector 3, which encloses the tube of the fluorescent lamp 2 so closely that the fluorescent lamp 2 in the reflector 3 is inaccessible to an operator. It is not possible for the lamp tube 2 to be gripped by the fingers of one hand and drawn out of the reflector 3 and/or the holders 6, 7. This is made possible, however, by a specific configuration of the holders 6, 7, which are identical.

Figure 3:
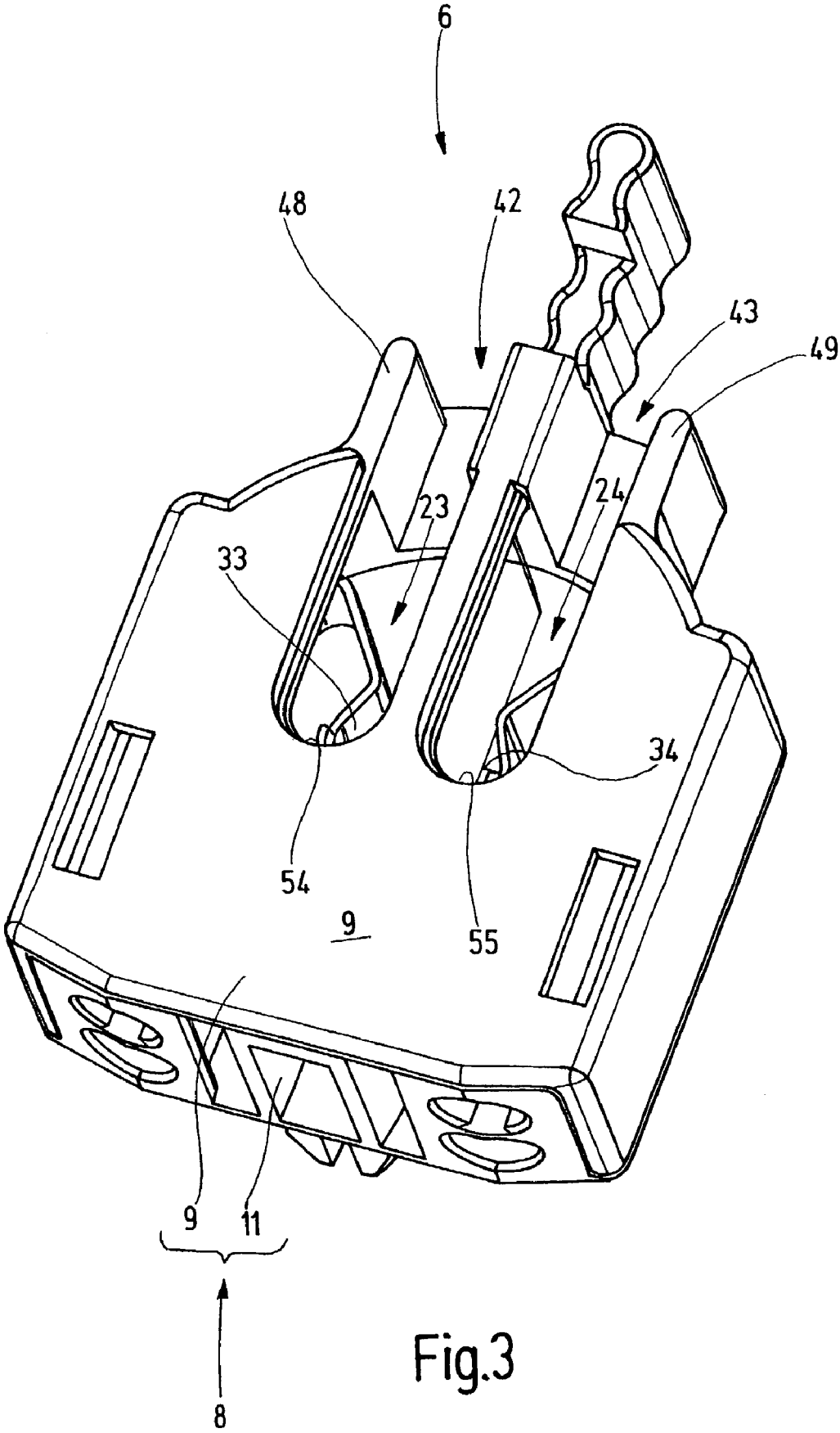
FIG. 3 shows a perspective illustration of a lamp holder of the luminaire according to FIG. 1 in the operating position.
Figure 4:
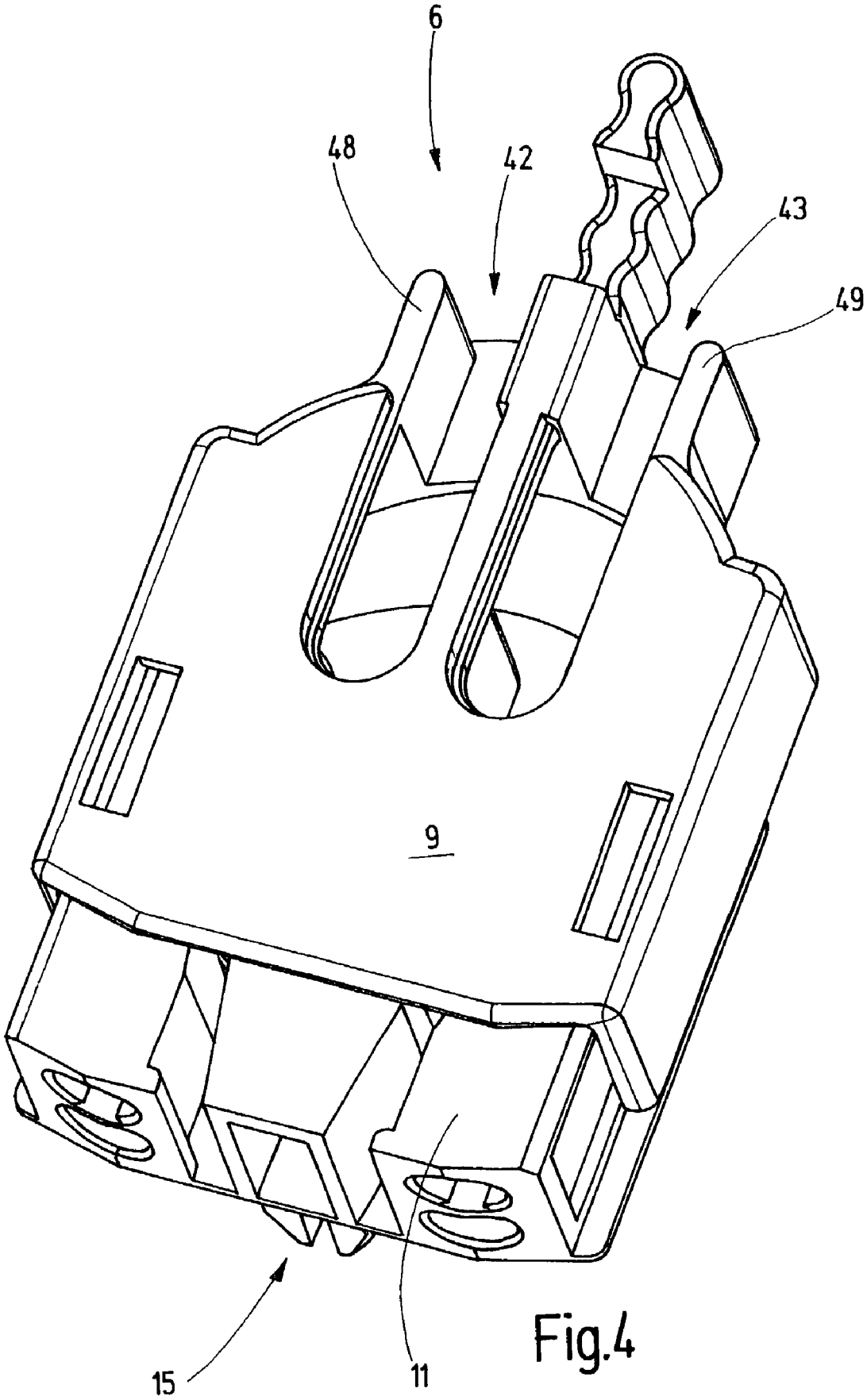
FIG. 4 shows a perspective illustration of the lamp holder according to FIG. 3 in the release position.
Figure 5:
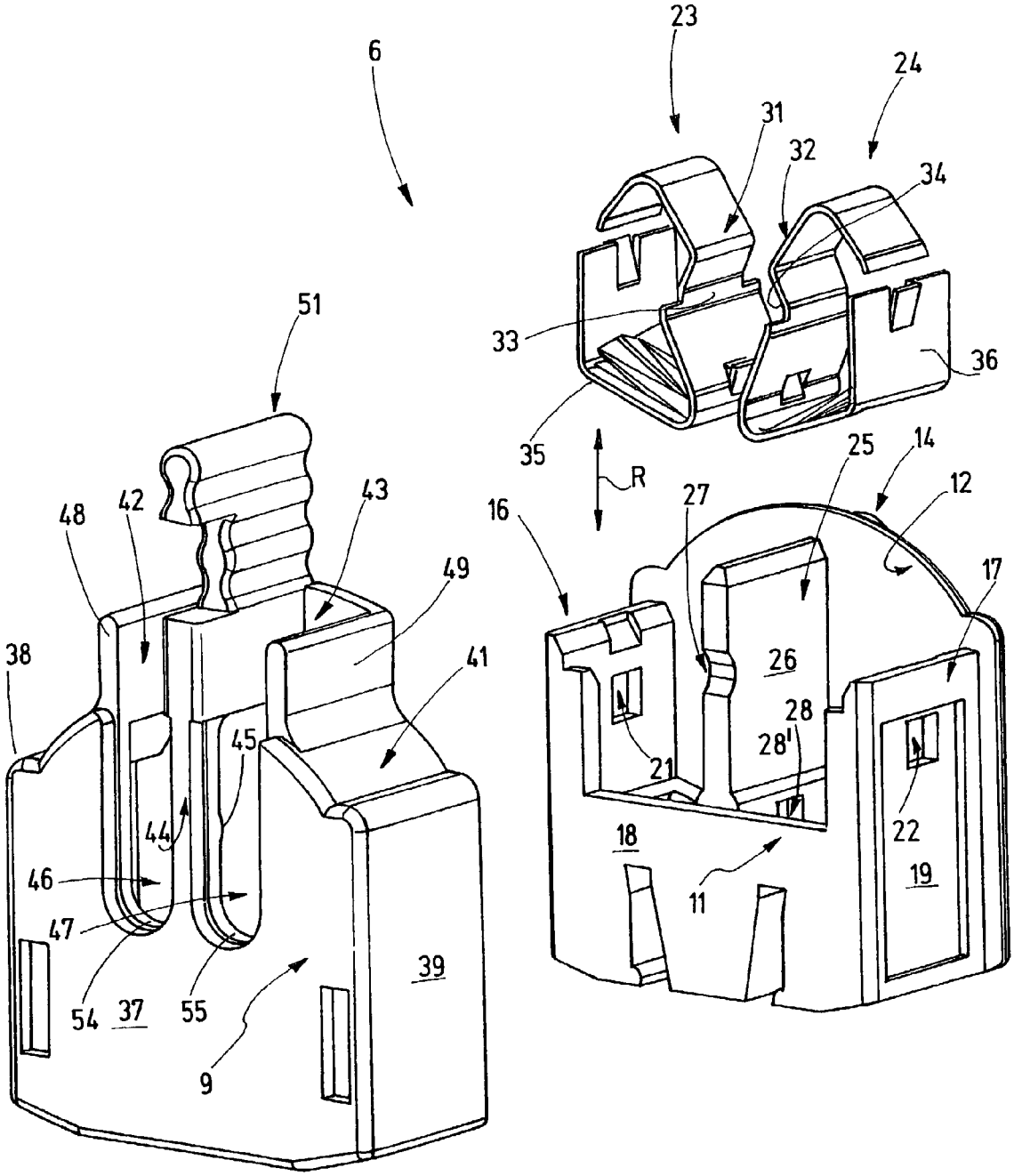
FIG. 5 shows an exploded illustration of the holder according to FIG. 3.

FIG. 3 illustrates the holder 6 as representative of both holders 6, 7. It has a holder housing 8 which is formed from plastic. In the present exemplary embodiment, it is constructed from two parts. It has a front housing part 9 made of a heat-resistant plastic and a rear part 11 made of the same plastic or of some other plastic. As can be seen from FIGS. 3 and 4 together, the housing part 9 is mounted in a displaceable manner on the rear part 11. The housing part 9 and the rear part 11 can each be seen separately from FIG. 5. The rear part 11 is formed in one piece and has a plate-like rear section 12, which forms the rear holder wall and bears fastening means 14, 15 on its rear side (FIGS. 4 and 5). These fastening means are designed, for example, as latching means, latching stubs, latching noses or the like. It is also possible, as an alternative, to provide other fastening means. For example, latching stubs may be integrally formed on the underside of the housing. It is also possible to form latching ribs at the bottom housing end, in order for the holder 6 to be designed as a push-in or push-through holder.

Projecting from the rear section 12 are two side walls 16, 17, which are spaced apart parallel to one another and are connected to one another by a front wall 18 at a distance from the rear section. The outside of the side walls 16, 17 in each case contains a shallow recess 19, which serves for fastening and guiding the housing part 9. The side walls 16, 17 also contain pockets 21, 22, which serve for arresting two contact elements 23, 24.

The contact elements 23, 24 are accommodated in an inner chamber 25 which is enclosed by the rear part 11 and is subdivided by a central wall 26 which is arranged centrally between the side walls 16, 17, parallel to the latter. The central wall 26 projects beyond the side walls 16, 17 in a direction R selected parallel to the rear section 12. It also projects beyond the front wall 18 to a considerable extent in the same direction. Those parts of the inner chamber 25 which have to accommodate the contact elements 23, 24 are thus open and free in the forward direction. A latching depression 27 is formed in the central wall 26 in this region. The central wall 26 also contains, on both sides, a pocket 28, 28' for fastening the contact elements 23, 24.

The contact elements 23, 24 are identical and symmetrical to one another. They each have a top contact region 31, 32 which forms a resiliently mounted leg. The contact region 31, 32 has a latching hollow 33, 34, which serves for mounting a connection pin of a fluorescent lamp or some other unit in a latching manner. The contact region 31, 32 is adjoined by a retaining section 35, 36, which has resilient clamping tongues for the contact-connection of electrical conductors and resilient tongues for latching in the pockets 21, 22, 28, 28'.

The housing part 9 is a sub-housing which is closed on four sides and has a front wall 37, two parallel side walls 38, 39, which extend in the rearward direction away from the front wall 37, at right angles thereto, and are integrally formed on mutually opposite edges of the front wall 37, and also a top, termination wall 41. The termination wall 41 and the front wall 37 have two parallel introduction slots 42, 43 passing through them. The spacing between the latter is only slightly greater than the width of the central wall 26. Integrally formed on the remaining crosspiece 44 is a latching protrusion 45 which is assigned to the latching depression 27. The introduction slots 42, 43 terminate approximately in the center of the front wall 37, the end regions 46, 47 provided here being the regions behind which the contact regions 31, 32 of the contact elements 23, 24 are located. The length of the introduction slots 42, 43 is greater than the respective end region plus the outer spacing between the pins of the fluorescent lamp which is to be connected. In order to achieve this, the mouth openings of the introduction slots 42, 43, said openings being located at the top termination wall 41, are extended by integrally formed insulating continuations 48, 49. Extending the introduction slots 42, 43 provides protection against shock when the fluorescent lamp is inserted into the holder.

Extending away from the front part 9 between said introduction slots, in extension of the crosspiece 44, is a flat profiled grip element 51, the latter extending in the longitudinal direction of the slots. The grip element 51 serves as a handle in order for it to be possible for the front part 9 to be displaced on the rear part 11.

Figure 8:
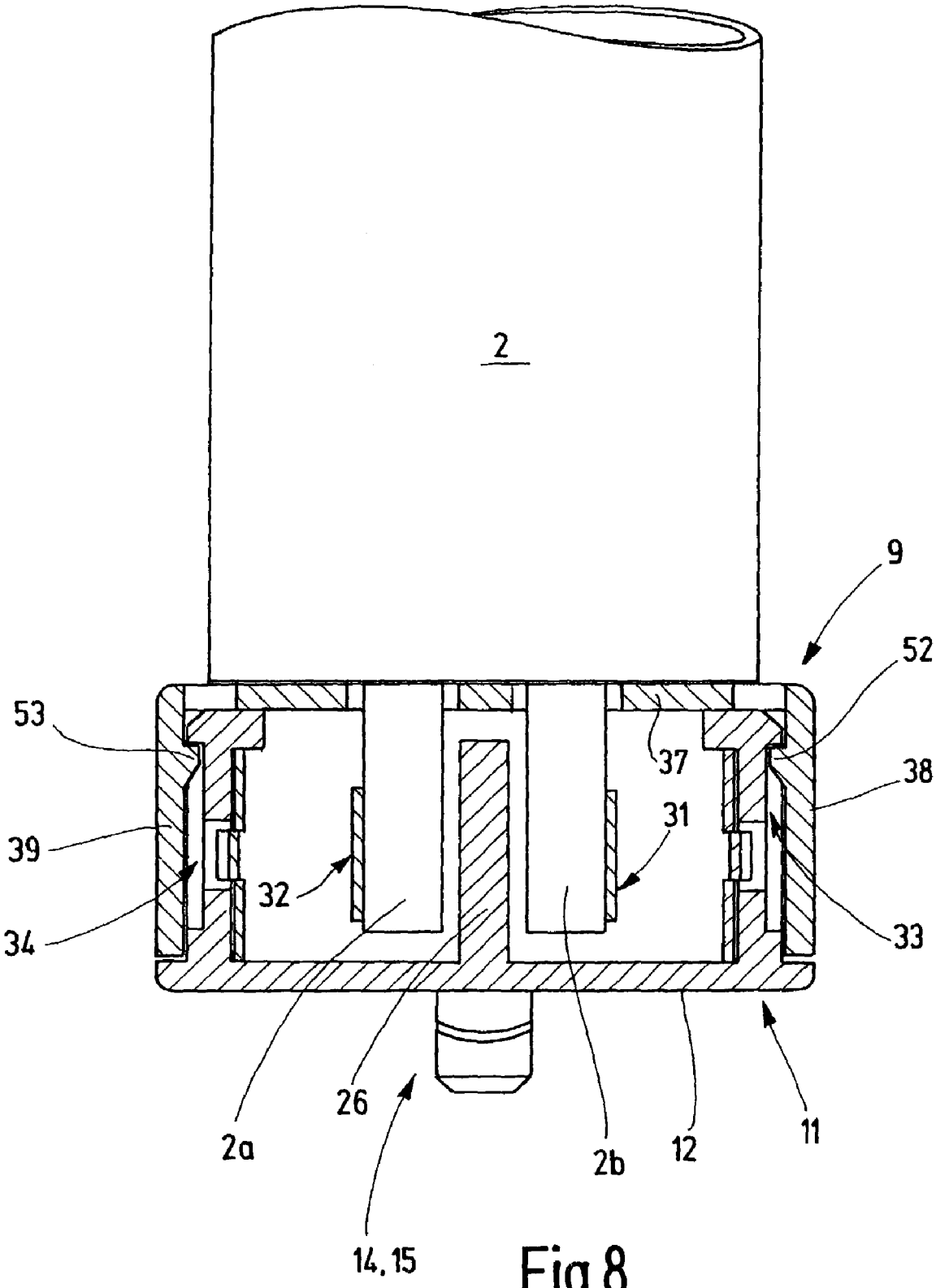
FIG. 8 shows the luminaire according to FIG. 1 in section along line VIII—VIII on a different scale.

The mounting of the housing part 9 on the rear part 11 can be seen from FIG. 8. Integrally formed on the insides of the side walls 38, 39 are guide ribs 52, 53, which engage in the latching hollows 33, 34 and thus mount the front part 9 on the rear part 11 such that it can be displaced to a limited extent. The displacement path here is large enough for it to be possible for the bottom end 54, 55 in each case (FIG. 3), which in an end position of the housing part 9 exposes the latching hollow 33, 34 of each contact element 23, 24 (FIG. 3), to be moved all the way out of the contact region 31, 32 of each contact element 23, 24 resting in the rear part 11. The displacement path of the housing part 9 is thus greater than the spacing between the latching hollow 33, 34 and the adjacent latching elevation in the direction of the free end.

The holder 6 or 7 which has been described thus far operates as follows:

It is assumed that the holders 6, 7 are located in the position illustrated in FIG. 3, and that no fluorescent lamp has as yet been inserted into the holder 6, 7. The fluorescent lamp is then inserted, by way of its two contact pins 2*a*, 2*b* (FIG. 8), into the introduction slots 42, 43 and latched by light pressure being applied. In this case, the contact pins 2*a*, 2*b* snap into the latching hollows 33, 34 of the contact elements 23, 24.

The operation of inserting the fluorescent lamp 2 into the holders 6, 7 does not differ to any significant extent if the holders 6, 7 are initially located in the position which is illustrated in FIG. 4. Once the contact pins 2*a*, 2*b* of the fluorescent lamp have been inserted into the introduction slots 42, 43, they push against the end surfaces 54, 55 and displace the housing part 9 of the holder 6 or 7 until they latch into the latching hollows 33, 34.

The fluorescent lamp 2 is then reliably contact-connected and retained in both cases. The luminaire 1 is ready for use.

Figure 6:
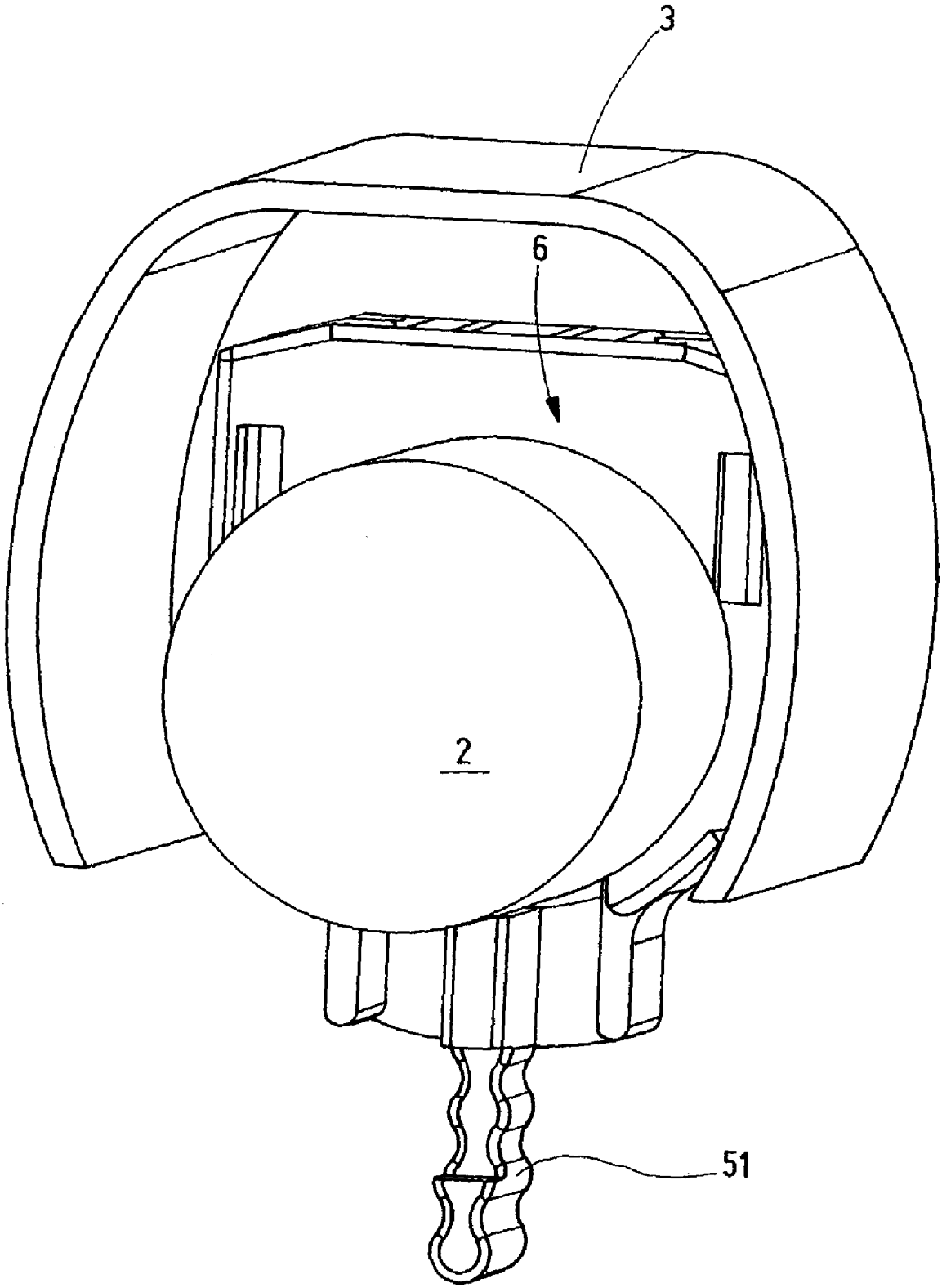
FIG. 6 shows a perspective illustration of the luminaire according to FIG. 1, in section along line VI—VI, in the operating position.
Figure 7:
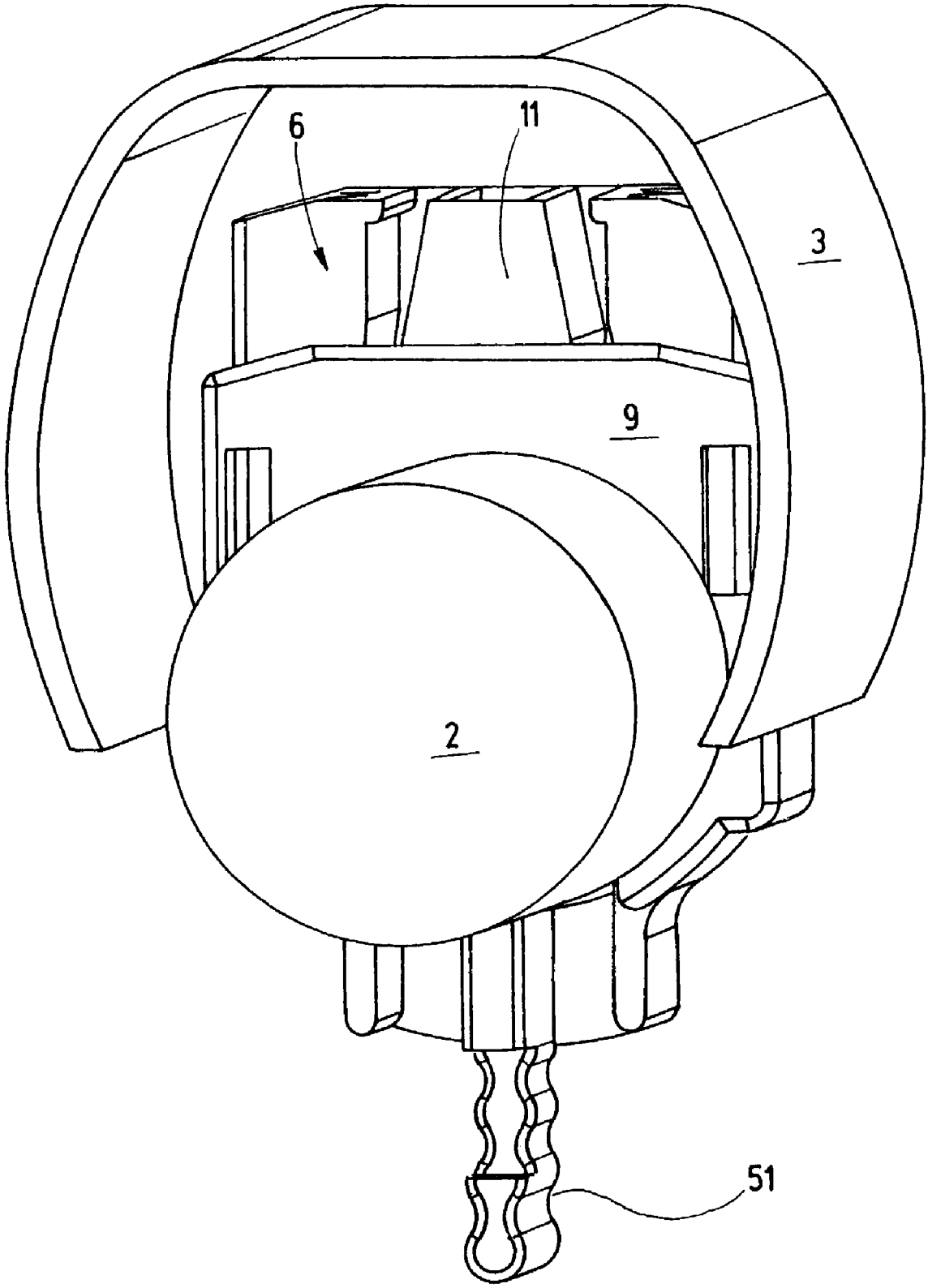
FIG. 7 shows the luminaire according to FIG. 6 in the release position.

If the fluorescent lamp is then to be removed from the luminaire 1 at a later point in time, direct access to the fluorescent lamp 2 is not possible. The reflector 3 prevents manual access to the fluorescent lamp 2. This state is illustrated in FIG. 6. The interspace between the reflector 3 and the fluorescent lamp 2 is too narrow for the fluorescent lamp 2 to be drawn out of the holders 6, 7 by hand. It is possible, however, for the operator to guide the fluorescent lamp 2 out of the holder 6 by gripping on the grip element 51 and pulling on the latter in the longitudinal direction thereof. The holder 6 is thus transferred into the position which is illustrated in FIG. 7. As a result, the connection pins of the fluorescent lamp 2 are guided out of the latching hollows 33, 34 at the same time. The end surfaces 54, 55 of the introduction slots 42, 43 push the contact pins 2*a*, 2*b* over the elevations of the contact regions 31, 32, said elevations being adjacent to the latching hollows 33, 34. The fluorescent lamp 2 is thus released from the holders 6, 7. Moreover, the fluorescent lamp 2 is moved some way out of the reflector 3, as is illustrated in FIG. 7. It is then easy to remove.

A holder 6, which is suitable in particular for luminaires which do not provide any direct manual access to the capped lighting means, has a slide by means of which the lamp cap and/or the contact pins 2*a*, 2*b* thereof can be pushed out of the holder or at least released from the holder. In the case of a preferred embodiment, the holder housing 8 is designed in two parts, the housing part 9 being designed as the slide.

It will readily be appreciated that the above description is merely exemplary of the structure, function, features and advantages of the invention. Various modifications will be apparent to those skilled in the art. It should be understood that the invention is not intended to be limited to the specific structure and examples described above.

What is claims:

1. A holder for electrical units, in particular for fluorescent lamps, comprising:

a holder housing comprising a front housing part and a rear housing part, wherein the front housing part is mounted in a displaceable manner on the rear housing part;

at least one contact element retained in the holder housing, wherein the at least one contact element is configured to connect to a contact pin of the unit; and a release device, comprising manually actuated device, wherein the release device is configured to guide the unit out of the holder;

wherein the front housing part forms the release device.

2. The holder as claimed in claim 1, wherein the front housing part forms at least one abutment surface in the release device for the unit.

3. The holder as claimed in claim 2, wherein the front housing part is moveable in a linear direction transversely oriented to the contact pin.

4. The holder as claimed in claim 2, wherein a grip element is provided on the front housing part, wherein the grip element is provided between two introduction slots.

5. The holder as claimed in claim 2, wherein the at least one abutment surface is configured to displace the unit when the front housing part is displaced relative to the rear housing part.

6. The holder as claimed in claim 2, wherein the front housing part is moveable between an operating position and a release position.

7. The holder as claimed in claim 6, wherein the front housing part includes a latching device, wherein the latching device comprises a latching position in the operating position.

8. The holder as claimed in claim 2, wherein the front housing part contains two introduction slots adapted to receive two contact pins of the unit, wherein contact regions of contact elements project into end regions of said slots;

wherein the end regions of said slots form abutment surfaces for the unit.

9. The holder as claimed in claim 8, wherein the abutment surfaces are configured to displace the unit when the front housing part is displaced relative to the rear housing part.

10. The holder as claimed in claim 1, wherein the front holder part contains at least one introduction slot to receive the contact pin of the unit, and wherein a contact region of the contact element projects into an end region of said slot.

11. The holder as claimed in claim 10, wherein at least one insulating continuation is arranged in a rectilinear extension of a lateral boundary of the slot.

12. The holder as claimed in claim 11, wherein at least one insulating continuation comprises a grip element.

13. The holder as claimed in claim 1, wherein the front housing part contains two introduction slots adapted to receive two contact pins of the unit, and wherein contact regions of contact elements project into end regions of said slots.

14. The holder as claimed in claim 13, wherein each introduction slot has length greater than the sum of the spacing between the contact pins and the length of the end region of an introduction slot.

15. The holder as claimed in claim 6, wherein a grip element is provided on the front housing part, wherein the grip element is provided between two introduction slots.

16. The holder as claimed in claim 1, further comprising a latching device adapted to retain the release device in an operating position.

17. The holder as claimed in claim 1, wherein the contact element includes a latching device.

18. The holder as claimed in claim 17, wherein the latching device of the contact element is dispesed arranged in an end region of an introduction slot arranged in the holder housing.

19. The holder as claimed in claim 1, wherein contact elements are mounted on the rear housing part.

20. The holder as claimed in claim 1, wherein fasteners are integrally formed on the rear housing part.

21. The holder as claimed in claim 1, wherein the front housing part is configured to displace relative to the rear housing part by sliding.

22. The holder as claimed in claim 1, wherein the front housing part is configured to displace relative to the rear housing part so that the unit is displaced with the front housing part.

23. The holder as claimed in claim 22, wherein the front housing part is configured to displace relative to the rear housing part by sliding.

* * * * *